US005226521A

United States Patent [19]

Oden

[11] Patent Number: 5,226,521

[45] Date of Patent: Jul. 13, 1993

[54] JACKET FOR A COIN CHANGER

[75] Inventor: Kenneth W. Oden, Charles Town, W. Va.

[73] Assignee: Royal Vendors, Inc., Kearneysville, W. Va.

[21] Appl. No.: 891,112

[22] Filed: Jun. 1, 1992

[51] Int. Cl.[5] ..... G07F 9/10

[52] U.S. Cl. ..... 194/350; 150/154

[58] Field of Search ..... 194/344, 347, 348, 349, 194/350; 150/154; 220/400, 403, 410; 383/33

[56] References Cited

U.S. PATENT DOCUMENTS

| | | | |
|---|---|---|---|
| 829,265 | 8/1906 | Goeb . | |
| 2,865,561 | 12/1958 | Rosapepe | 232/7 |
| 4,165,802 | 8/1979 | Mathews | 194/344 |
| 4,230,213 | 10/1980 | Spring . | |
| 4,306,644 | 12/1981 | Rockola et al. . | |
| 5,027,937 | 7/1991 | Parish et al. | 194/348 |
| 5,080,155 | 1/1992 | Crozier | 150/154 |

OTHER PUBLICATIONS

A brochure for a model by Coinco Publication, "The 9302-L (24 Volt) Coin Changer" Dec., 1988.

*Primary Examiner*—F. J. Bartuska

*Attorney, Agent, or Firm*—Mason, Fenwick & Lawrence

[57] ABSTRACT

A protective device for a mechanism which accepts coins through a raised coin slot comprises a jacket made from an elastic material and conforming substantially to the configuration of the mechanism. The jacket has an open end for insertion over the mechanism, a coin slot aperture positioned and dimensioned to snugly receive the coin slot, and a raised lip surrounding the coin slot aperture. The jacket further includes a cable aperture positioned to receive an electrical cable extending from the mechanism and an elongated tube surrounding the cable aperture, and a closed, raised protrusion positioned to cover a release lever extending from the mechanism. The elastic material can be latex rubber or a synthetic plastic.

10 Claims, 2 Drawing Sheets

JACKET FOR A COIN CHANGER

BACKGROUND OF THE INVENTION

1. Field of the Invention

The present invention relates to devices for preventing tampering with coin-operated devices. More specifically, the invention relates to an anti-tampering jacket for preventing the "salting" of coin changers and other coin acceptor and coin acceptor/pay-out devices which employ electronic coin validators and other electronic mechanisms.

2. Related Art

Vending machines and other coin-operated devices employ coin acceptor and coin acceptor/pay-out devices, such as coin changers for the convenience of users who do not have exact change. These coin acceptor and coin acceptor/pay-out devices employ electronic coin validators and other electronic mechanisms which are susceptible to a form of tampering known as "salting," that is, pouring salt water into the device in order to short out its circuitry and cause either "jackpotting," that is, the dispensing of all the coins in the coin acceptor, or a free vend.

Devices to prevent tampering with coin-operated machines and their coin acceptors are numerous. For example, U.S. Pat. No. 829,265 to Goeb discloses a casing having a main body portion which encloses the operative mechanism of a coin-controlled machine (specifically, a pay telephone), and a separable cash receptacle capable of being locked to the body portion of the casing. The purpose of the casing is to make the cash receptacle inaccessible to an unauthorized person, but removable by an authorized person. The coin-controlled machine contemplated by Goeb is entirely mechanical in nature, and Goeb does not contemplate or solve the problem of the shorting of circuitry by exposure to salt water or other liquid.

U.S. Pat. No. 2,865,561 to Rosapepe discloses a fare collection box having a perforated water separator incorporated into the coin chute and a water-collection chamber disposed behind the water separator to collect water draining from the coin chute. Rosapepe requires the modification of a standard coin-operated device to incorporate his water separator, and also does not address the problem of the effect of liquid entering the device through spaces other than the coin chute. Further, if the perforations become clogged, the water separator will not function.

U.S. Pat. No. 5,027,937 to Parish et al. addresses the specific problem caused by the introduction of salt water or other liquid into the coin chute of a vending machine. Parish et al. employ a liquid-diverting coin chute which includes a first aperture for delivering coins to the coin receptor of the vending machine, a second aperture for dispensing liquid from the coin chute, and a screen disposed in the coin chute and having a plurality of apertures therein for passage of liquid to the second aperture. Like Rosapepe, Parish et al. require modification of a standard coin hopper to incorporate their liquid-diverting coin chute; and if the apertures in the screen become clogged, the coin chute will not divert the liquid as intended.

U.S. Pat. No. 4,230,213 to Spring also addresses the specific problem caused by the introduction of salt water or other liquid into the coin chute of a vending machine. Spring provides a liquid-rejecting coin chute comprising a liquid-pervious gate extending across the bottom of the chute, which separates the liquid from the coins. Spring also requires modification of a standard vending machine to incorporate his liquid-rejecting coin chute, and will malfunction if the grid forming the gate becomes clogged.

U.S. Pat. No. 4,306,644 to Rockola et al. also addresses the "salting" of vending machines by employing a coin chute which is designed to prevent liquid from flowing down the funnel of the coin receptor. Water is diverted by a drain comprising a plurality of vertically oriented, parallel ribbed walls 40. Liquid which passes through this drain is further diverted by limber openings 86 and 87 further downstream. Like the preceding patents to Rosapepe, Parish et al., and Spring, Rockola et al. require modification of a standard vending machine to incorporate their coin chute. Further, Rockola et al.'s coin chute permits liquid to fall onto the top of the coin receptor, so that the liquid can enter the coin receptor through spaces in the top and sides and still short the interior circuitry.

It is the solution of these and other problems to which the present invention is directed.

SUMMARY OF THE INVENTION

It is therefore a primary object of the present invention to provide a device which will prevent damage to the electrical circuitry of the coin acceptor of a vending machine resulting from "salting," yet does not require modification of any of the mechanisms of the vending machine.

It is another object of the present invention to provide a device which will prevent damage to the electrical circuitry of the coin acceptor of a vending machine resulting from "salting," and which is not subject to clogging.

It is still another object of the present invention to provide a jacket for the coin acceptor of a vending machine which will prevent salt water or other liquid from contacting the electrical circuitry of the coin acceptor.

These and other objects of the invention are achieved by the provision of a protective device for a mechanism which accepts coins through a raised coin slot, in which the device comprises a jacket made from an elastic material and conforming substantially to the configuration of the mechanism. The jacket has an open end for insertion over the mechanism, a coin slot aperture positioned and dimensioned to snugly receive the coin slot, and a raised lip surrounding the coin slot aperture.

The jacket further includes a cable aperture positioned to receive an electrical cable extending from the mechanism and an elongated tube surrounding the cable aperture, and a closed, raised protrusion positioned to cover a release lever extending from the mechanism.

Preferably, the elastic material is latex rubber or a synthetic plastic.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
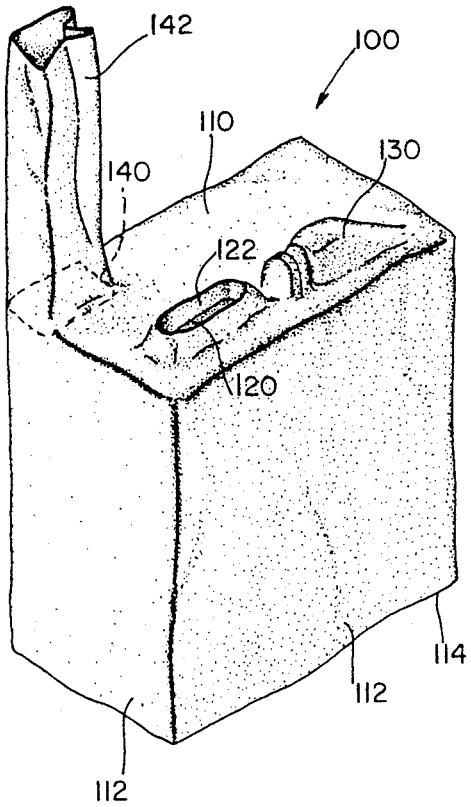
FIG. 1 is a perspective view of an anti-tampering shield for a coin changer in accordance with the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Figure 2:
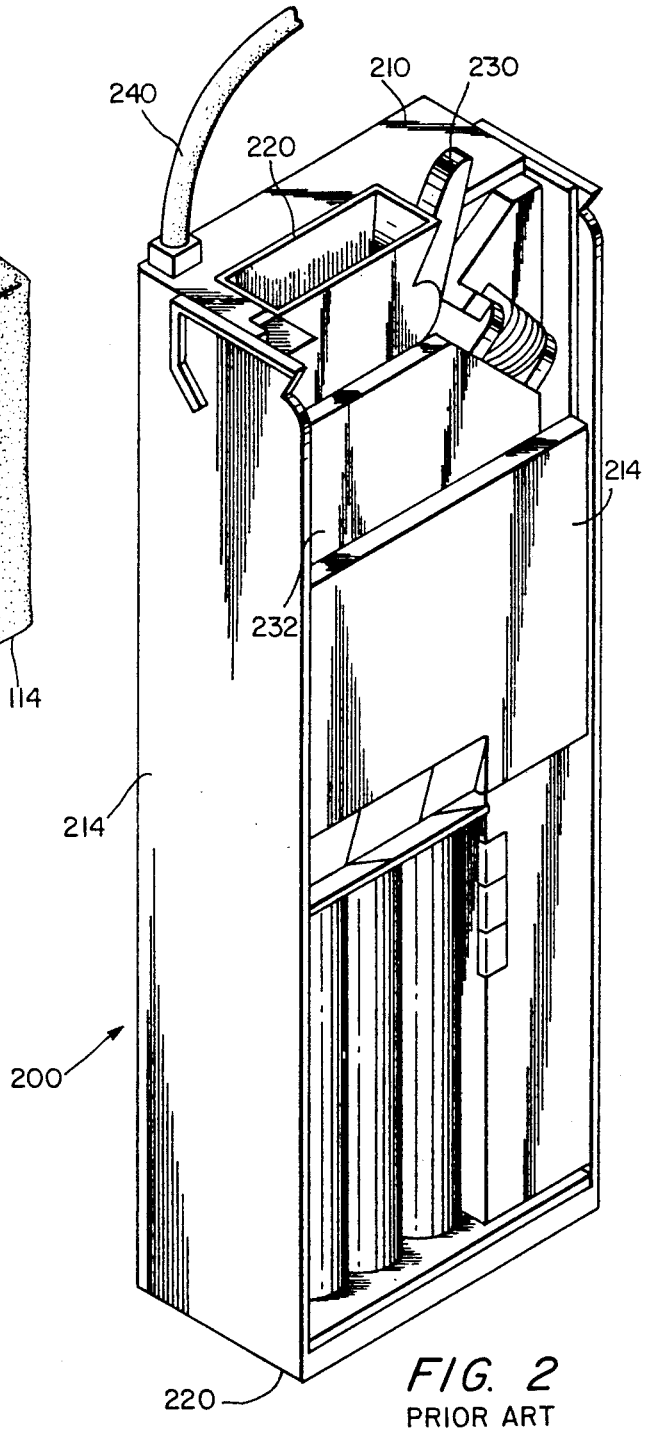
FIG. 2 PRIOR ART
FIG. 2 is a perspective view of a conventional coin changer of the type with which the anti-tampering shield of FIG. 1 can be used.
Figure 3:
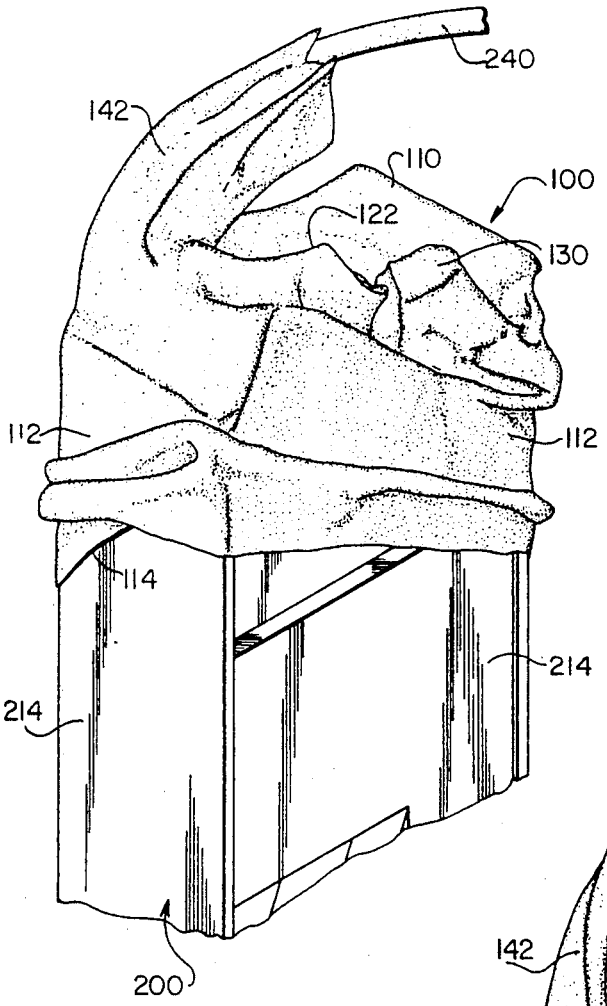
FIG. 3 is a perspective view showing the anti-tampering shield of FIG. 1 being placed over the coin changer of FIG. 2.
Figure 4:
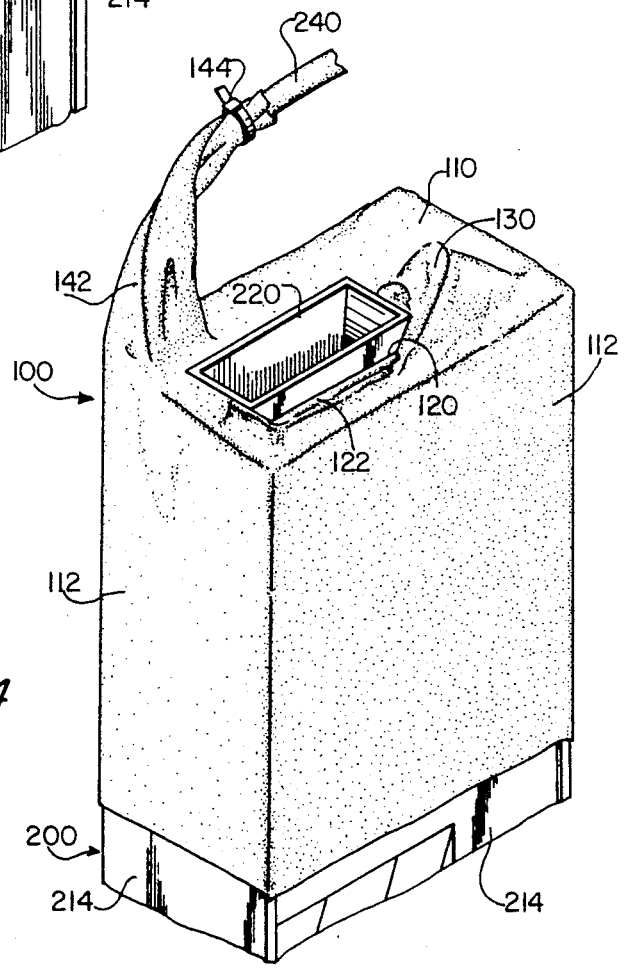
FIG. 4 is a perspective view of the anti-tampering shield of FIG. 1 in place over the coin changer of FIG. 2.

Referring now to FIGS. 1, 3, and 4, there is shown an anti-tampering jacket 100 for use with a conventional coin acceptor such as a coin changer 200 of the type shown in FIG. 2. It should be understood that jacket 100 can be used with any conventional coin acceptor, and not just with the particular model of coin changer 200 shown in FIGS. 2–4, which is a model 9302-L (24 volt) coin changer sold by Coin Acceptors, Inc., of St. Louis, Mo.

A conventional coin changer such as coin changer 200 is generally rectangular, having rectangular top and bottom walls 210 and 212, and rectangular side walls 214. A coin slot 220 extends upwardly from top wall 210, as does a release lever 230, which opens an upper front panel 232 of one of side walls 214 for the release of bent coins. An electric power cable 240 also extends outwardly from top wall 210.

As can be seen from FIG. 2, coin changer 200 has numerous spaces 250, particularly in top wall 210, where salt water or other liquid can enter and reach the internal circuitry.

The purpose of jacket 100 is to cover these openings 250 and to divert the salt water into coin slot 220, where it will not affect the internal circuitry of coin changer 200. Thus, jacket 100 is generally form-fitting of coin changer 200, being made from an elastic material such as latex rubber or a synthetic plastic, and having a substantially rectangular top 110 and four substantially rectangular sides 112 conforming substantially to the configurations of top and side walls 210 and 14, respectively, of coin changer 200. Jacket 100 also has an open bottom 114 for insertion over coin changer 200.

A coin slot aperture 120 is formed in top 110, positioned and dimensioned to snugly receive coin slot 220. A raised lip 122 can surround coin slot aperture 120, and can be folded down around coin slot 120 as shown in FIG. 4, in order to form a tight seal around coin slot 120. As shown in FIGS. 1, 3, and 4, raised lip 122 has a generally trapezoidal configuration. However, the specific configuration of raised lip 122 is not critical, as long as it fits snugly around coin slot 120 and can be folded down around coin slot 120 to form a tight seal.

A closed, raised protrusion 130 is also formed in top 110 to cover release lever 230. Because the release lever 230 can take on different configurations depending upon the model and manufacturer of the coin changer, protrusion 130 is not form-fitting with respect to release lever 230, but is provided with a shape which can accommodate a variety of configurations of release levers.

In order to accommodate cable 240, top 110 also has formed therein a cable aperture 140 and an elongated tube 142 extending outwardly from and surrounding cable aperture 140. As shown in FIGS. 1, 3, and 4, tube 142 has a generally rectangular configuration. However, the specific configuration of tube 142 is not critical, as long as it covers a sufficient portion of cable 240 and can accommodate the passage of an electrical plug (not shown) which terminates cable 240. The top of tube 142 can be closed around cable 240 by a conventional cable tie 144, a piece of tape, or similar closure means.

Jacket 100 is made by any conventional molding process, for example, the dipping process which is commonly used in molding latex rubber.

In use, coin changer 200 is completely enclosed inside of a vending machine. Thus, once a jacket 100 in accordance with the present invention has been placed over coin changer 200 and coin changer 200 has been installed in the vending machine, jacket 100 also is inaccessible to the user of the vending machine and cannot itself be tampered with from the outside. Any attempt to pour liquid into the coin slot of the vending machine will result in the liquid either running off of jacket 100 or being diverted into coin slot 220.

Modifications and variations of the above-described embodiments of the present invention are possible, as appreciated by those skilled in the art in light of the above teachings. For example, the configurations of raised lip 122, protrusion 130, and elongated tube 142 can be varied as long as they maintain their intended functions.

It is therefore to be understood that, within the scope of the appended claims and their equivalents, the invention may be practiced otherwise than as specifically described.

What is claimed is:

1. A protective device for a mechanism which accepts coins through a raised coin slot, said device comprising a jacket made from an elastic material, said jacket conforming substantially to the configuration of the mechanism and having an open end, a coin slot aperture positioned and dimensioned to snugly receive the coin slot, and a raised lip surrounding said coin slot aperture.

2. The device of claim 1, wherein said jacket further includes a cable aperture positioned to receive an electrical cable extending from the mechanism and an elongated tube extending outwardly from and surrounding said cable aperture.

3. The device of claim 1, wherein said jacket further includes a closed, raised protrusion positioned to cover a release lever extending from the mechanism.

4. The device of claim 3, wherein said jacket further includes a closed, raised protrusion positioned to cover a release lever extending from the mechanism.

5. The device of claim 1, wherein said elastic material is latex rubber.

6. A protective device for a substantially rectangular, coin-accepting mechanism having opposed rectangular top and bottom walls, four rectangular side walls, and a raised coin slot extending from the top wall, said device comprising a jacket made from an elastic material, said jacket having a substantially rectangular top and four substantially rectangular sides conforming substantially to the configuration of the top and side walls of the mechanism, an open bottom, a coin slot aperture formed in said top positioned and dimensioned to snugly receive the coin slot, and a raised lip surrounding said coin slot aperture.

7. The device of claim 6, wherein said jacket further includes a cable aperture formed in said top positioned to receive an electrical cable extending from the top wall of the mechanism and an elongated tube extending outwardly from and surrounding said cable aperture.

8. The device of claim 6, wherein said jacket further includes a closed, raised protrusion formed in said top positioned to cover a release lever extending upwardly from the top wall of the mechanism.

9. The device of claim 8, wherein said jacket further includes a closed, raised protrusion formed in said top positioned to cover a release lever extending upwardly from the top wall of the mechanism.

10. The device of claim 6, wherein said elastic material is latex rubber.

* * * * *